US010232418B2

(12) United States Patent
Hayashi

(10) Patent No.: US 10,232,418 B2
(45) Date of Patent: Mar. 19, 2019

(54) METHOD FOR PRODUCING SEAMLESS METAL PIPE

(71) Applicant: NIPPON STEEL & SUMITOMO METAL CORPORATION, Tokyo (JP)

(72) Inventor: Chihiro Hayashi, Sendai (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 113 days.

(21) Appl. No.: 15/125,699

(22) PCT Filed: Mar. 16, 2015

(86) PCT No.: PCT/JP2015/001439
§ 371 (c)(1),
(2) Date: Sep. 13, 2016

(87) PCT Pub. No.: WO2015/141211
PCT Pub. Date: Sep. 24, 2015

(65) Prior Publication Data

US 2017/0001225 A1 Jan. 5, 2017

(30) Foreign Application Priority Data

Mar. 19, 2014 (JP) ..... 2014-056370

(51) Int. Cl.
*B21D 19/04* (2006.01)
*B21B 19/04* (2006.01)
*B21B 27/02* (2006.01)

(52) U.S. Cl.
CPC ..... *B21B 19/04* (2013.01); *B21B 27/025* (2013.01); *B21B 2267/06* (2013.01)

(58) Field of Classification Search
CPC ... B21B 19/04; B21B 19/02; B21B 2267/065; B21B 2267/06; B21B 27/025
See application file for complete search history.

(56) References Cited

U.S. PATENT DOCUMENTS 1,957,916 A * 5/1934 Stiefel ..... B21B 19/02 72/100
4,416,134 A * 11/1983 Hayashi ..... B21B 19/06 72/100

(Continued)

FOREIGN PATENT DOCUMENTS

JP 6059042 12/1985
JP 05-23842 4/1993

(Continued)

*Primary Examiner* — Pradeep C Battula
(74) *Attorney, Agent, or Firm* — Clark & Brody

(57) ABSTRACT

A solid billet is piercing-rolled using a 4 roll-type inclined rolling mill including larger-diameter cone-type main rolls arranged horizontally or vertically to face each other across a pass line and smaller-diameter auxiliary rolls arranged vertically or horizontally to face each other similarly across the pass line between the facing main rolls, while maintaining a feed angle β and cross angle γ of the main rolls and a feed angle β' and cross angle γ' of the auxiliary rolls to be within the ranges: 5°≤"β, β'"≤25°; 3°≤"γ, γ'"≤35°; and 10°≤"β+γ, β'+γ'"≤55°.

5 Claims, 4 Drawing Sheets

(56) References Cited

U.S. PATENT DOCUMENTS

| | | | | | |
|---|---|---|---|---|---|
| 4,470,282 | A * | 9/1984 | Hayashi | B21B 19/04 | 72/97 |
| 4,510,787 | A * | 4/1985 | Hayashi | B21B 19/06 | 29/527.7 |
| 4,512,177 | A * | 4/1985 | Hayashi | B21B 1/20 | 29/527.7 |
| 4,827,750 | A * | 5/1989 | Hayashi | B21B 19/04 | 72/97 |
| 5,636,542 | A * | 6/1997 | Yamakawa | B21B 19/04 | 72/97 |
| 5,699,690 | A * | 12/1997 | Furugen | B21B 19/02 | 72/69 |
| 5,713,234 | A * | 2/1998 | Yamakawa | B21B 19/04 | 72/97 |
| 7,146,836 | B2 * | 12/2006 | Hayashi | B21B 19/04 | 72/97 |
| 7,536,888 | B2 * | 5/2009 | Yamakawa | B21B 19/04 | 72/366.2 |

FOREIGN PATENT DOCUMENTS

| | | |
|---|---|---|
| JP | 10-94808 | 4/1998 |
| JP | 3082489 | 8/2000 |
| JP | 2001-259710 | 9/2001 |
| JP | 4196991 | 12/2008 |

* cited by examiner

METHOD FOR PRODUCING SEAMLESS METAL PIPE

TECHNICAL FIELD

The present invention relates to a method for producing a seamless metal pipe, and more particularly, to a method for producing a seamless metal pipe, capable of producing a thin-wall mother pipe (hollow piece) particularly by piercing-rolling a billet made of a less formable material at a high reduction rate.

BACKGROUND ART

Most commonly employed processes for producing a seamless pipe include the Mannesmann-plug mill process and Mannesmann-mandrel mill process. In these processes, a solid billet heated to a predetermined temperature in a furnace is pierced by a piercing-rolling mill to be formed into a hollow, bar-shaped hollow piece, which is then reduced mainly in wall thickness by an elongator such as a plug mill or a mandrel mill to be formed into a hollow shell. Then, the hollow shell is reduced mainly in outside diameter by a reducing mill such as a sizer or a stretch reducer to be formed into a hot finished seamless pipe of a predetermined size. The present invention relates to a method for producing a seamless metal pipe, the method including producing a thin-wall hollow piece particularly by piercing-rolling a billet made of a less formable material at a high reduction rate in the first step of piercing-rolling among the above-mentioned steps.

First of all, inventions that have been proposed by the present inventor and others in Patent Literatures 1 to 4 will be described as conventional techniques.

The invention of Patent Literature 1 (hereinafter referred to as the first prior invention) is a method in which piercing-rolling is performed in such a manner that a feed angle β of cone-type main rolls supported at both ends and arranged horizontally or vertically to face each other across the pass line along which the billet or the hollow piece passes and a cross angle γ of the main rolls are maintained to be within the ranges defined by the following Formulae (1)' to (3)', with the billet or the hollow piece being pressed by the surfaces of disc rolls arranged vertically or horizontally to face each other across the pass line between the main rolls.

$$3° \leq \beta \leq 25° \quad (1)'$$

$$3° \leq \gamma \leq 25° \quad (2)'$$

$$15° \leq \beta + \gamma \leq 45° \quad (3)'$$

The feed angle β is an angle of the roll axis line with respect to a horizontal plane or a vertical plane of the pass line, and the cross angle γ is an angle of the roll axis line with respect to a vertical plane or a horizontal plane of the pass line.

The first prior invention fundamentally negates the piercing principle of the Mannesmann piercing process. The conventional Mannesmann piercing process is a piercing-rolling process in which a solid billet is pierced utilizing the so-called rotary forging effect (Mannesmann effect) to create a condition that facilitates piercing, whereas the first prior invention is based on the technical ideas of:

(i) inhibiting the occurrence of the rotary forging effect (Mannesmann effect) as much as possible; and (ii) inhibiting circumferential shear deformation $\gamma_{r\theta}$ and shear deformation $\gamma_{\beta 1}$ due to surface twist which occur during the piercing process as much as possible to realize a metal flow comparable or nearly comparable to that of the extrusion pipe-making process when it is inclined rolling.

To achieve the purpose, the piercing rolling mill is configured so as to enable high cross angle and high feed angle piercing, with the shape of the main rolls being of the cone type and disc rolls being employed instead of guide shoes.

The invention of Patent Literature 2 (hereinafter referred to as the second prior invention) is a method for producing a seamless pipe in which: a feed angle β of cone-type main rolls supported at both ends and arranged horizontally or vertically to face each other across the pass line along which the billet or the hollow piece passes and a cross angle γ of the main rolls are maintained to be within the ranges defined by the following Formulae (1) to (3); the diameter $d_o$ of the solid billet and the outside diameter d and wall thickness t of the hollow piece after the piercing-rolling satisfy the following Formula (4); and the piercing ratio is 4.0 or more, the pipe expansion ratio is 1.15 or more, or the "wall thickness-to-outside diameter" ratio is 6.5 or less.

$$8° \leq \beta \leq 20° \quad (1)$$

$$5° \leq \gamma \leq 35° \quad (2)$$

$$15° \leq \beta + \gamma \leq 50° \quad (3)$$

$$1.5 \leq -\Psi_r/\Psi_\theta \leq 4.5 \quad (4)$$

where $\Psi_r = \ln(2\ t/d_0)$ $\Psi_\theta \ln \{2(d-t)/d_0\}$

The second prior invention described above, similarly to the first prior invention, is a method designed to inhibit, as much as possible, the rotary forging effect and redundant shear deformation, which significantly occur in a piercing-rolling step, particularly a thin-wall piercing-rolling step at a high reduction rate, by maintaining the feed angle β and cross angle γ of the rolls to be within a suitable range. In addition, the method is designed to prevent inner surface flaws and laminations (cracks that can occur in the wall thickness central portion) that can occur in production of stainless steel pipes or high alloy steel pipes and further to reduce operational troubles such as pipe wall flaring, pipe wall peeling, and tail clogging by optimizing the distribution of the circumferential strain $\Psi_\theta$ and thicknesswise strain $\Psi_r$ so as to satisfy the relationship represented by Formula (4). Here, it is to be noted that, in the second prior invention, Formula (4) means that, for accomplishing high reduction rate thin-wall piercing, a high piercing ratio piercing process is not selected but a high pipe expansion ratio piercing process is employed.

In view of what is written in Claims, the first prior invention is not necessarily limited to the pipe expansion piercing process solely but the second prior invention is clearly limited to high pipe expansion ratio piercing.

The above two prior inventions imply that, in order to stably pierce a less formable material such as a stainless steel or a high alloy steel without causing inner surface flaws or laminations, the roll gorge diameter should be as small as possible relative to the billet diameter. However, reduction of the roll gorge diameter requires, in light of the roll structure, that roll shaft diameters at the entry side and the exit side also be reduced. Then, the strength of the bearing that supports the roll shaft would be insufficient, and particularly in the case of a cone-type roll, the fatigue strength of the bearing at the entry side would be insufficient, leading to the problem of durability. Thus, excessive reduction of the roll gorge diameter is not recommendable for actual operation.

Next, the object of the invention of Patent Literature 3 (hereinafter referred to as the third prior invention) is to provide a piercing-rolling method capable of inhibiting the rotary forging effect as much as possible and inhibiting redundant shear deformation as much as possible while avoiding excessive reduction of the roll gorge diameter.

As described above, the present inventor proposed a high cross angle expanding-piercing-rolling process in order to kill the rotary forging effect and inhibit redundant shear deformation, and thus made the second prior invention. However, although enlargement of the cross angle is a necessary condition for killing the rotary forging effect and inhibiting redundant shear deformation, it is not a sufficient condition. The necessary and sufficient condition is optimization of the roll shape while enlargement of the cross angle is a necessary condition for optimizing the roll shape.

In the piercing-rolling method of the third prior invention, the relative relationship between the pipe expansion ratio of the pipe material and the diameter expansion ratio of the cone-type main rolls is optimized. As a result, the rotary forging effect during piercing-rolling is significantly inhibited, and thus it is possible to more reliably inhibit inner surface flaws and laminations, which are likely to occur during the process of high reduction rate thin-wall piercing-rolling of a less formable material such as a stainless steel or a high alloy steel.

In the third prior invention, in addition to the above-mentioned (1) to (4), the following formulae (5) and (6) defining the relationship between the inlet diameter $D_1$ of the main roll, the outlet diameter $D_2$ thereof, the diameter do of the billet, the diameter d thereof after the piercing, and the cross angle γ are further satisfied.

$$(d/d_0)/(0.75+0.025\gamma)\leq(D_2/D_1) \quad (5)$$

$$D_2/D_1\leq(d/d_0)/(1.00-0.027\gamma) \quad (6)$$

When discussing the relationship between the pipe expansion ratio "$d/d_0$", the roll diameter expansion ratio "$D_2/D_1$", and the roll cross angle γ, whether the roll shape is suitable or unsuitable needs to be determined by the rotary forging effect, and here, the determination criterion is whether the ductility (reduction value) of the central portion of the billet immediately before being contacted by the plug tip can be made greater than the reduction value of the billet itself. The above Formula (5) is an essential requirement for specifying the roll shape, but Formula (6) is not necessarily a requirement because, in many cases, it is satisfied unintentionally.

The invention of Patent Literature 4 (hereinafter referred to as the fourth prior invention) is an invention relating to a technique of installing disc rolls, but it is not described here because, in the present invention, disc rolls are not used as detailed below.

CITATION LIST

Patent Literature

Patent Literature 1: Japanese Patent No. 1608310

Patent Literature 2: Japanese Patent Publication No. H05-23842

Patent Literature 3: Japanese Patent No. 4196991

Patent Literature 4: Japanese Patent No. 3082489

Patent Literature 5: Japanese Patent Application Publication No. H10-94808

Patent Literature 6: Japanese Patent Application Publication No. 2001-259710

SUMMARY OF INVENTION

Technical Problem

All of these inventions specify the ranges of the feed angle β of cone-type main rolls supported at both ends and arranged horizontally or vertically to face each other across the pass line (an angle of the main roll axis line with respect to a horizontal plane or a vertical plane of the pass line) and the cross angle γ of the main rolls (an angle of the main roll axis line with respect to a vertical plane or a horizontal plane of the pass line), then optimizes the distribution ratio between the radial logarithmic strain $\Psi_r$ and the circumferential logarithmic strain $\Psi_\theta$, and further optimizes the relationship between the pipe expansion ratio of the pipe material and the diameter expansion ratio of the cone roll diameter.

As described above, all of these inventions fundamentally negate the piercing principle of the Mannesmann piercing process and, in contrast to the conventional Mannesmann piercing process, which is a piercing-rolling process of piercing utilizing the rotary forging effect (Mannesmann effect), they were invented from the standpoints of inhibiting the occurrence of the rotary forging effect as much as possible and also inhibiting, to the extent possible, redundant shear deformations $\gamma_{r\theta}$ and $\gamma_{\theta 1}$, which can occur during piercing.

In these cases, disc rolls arranged vertically or horizontally to face each other across the pass line between the cone-type main rolls are driven, and piercing-rolling is carried out with the grooved surfaces of the disc rolls being pressed against the billet or the hollow piece.

Disc rolls have been employed in real operations for about 30 years in place of the older stationary guide shoes, but they pose the following problems.

(1) While piercing-rolling proceeds in a spiral manner about the pass center with inclined rolling using cone-type main rolls, the disc rolls rotate in a direction substantially perpendicular to this, and thus, if the disc roll position setting is inappropriate, head clogging or tail clogging will occur during piercing.

(2) Also, there is a risk that the wall of the hollow piece may be peeled by the edge surface of the disc roll groove, and therefore high reduction rate thin-wall piercing is particularly difficult.

In order to solve the above problems and achieve further improvement of performance, the present inventor decided to discontinue the use of disc rolls and instead employ cone-type auxiliary rolls having a smaller diameter than cone-type main rolls but having functions and advantages comparable to those of the main rolls. That is, he decided to develop a 4 roll-type cross piercing mill. By shifting from the 2 roll-type cross rolling technique to the 4 roll-type cross rolling technique, functions and advantages for avoiding further problems described below can be expected.

(3) When a solid billet is subjected to rotary-forging in a 2 roll-type inclined rolling mill, compressive stresses act on the central axis portion of the solid billet in the direction of reduction and tensile stresses occur in the direction perpendicular to the direction of reduction, with the result that the so-called Mannesmann phenomenon occurs at the centerline segregation, inclusions, or centerline porosity serving as the initiation point, and if the phenomenon is excessive, it will cause a failure.

When a 4 roll-type inclined rolling mill is employed in place of the 2 roll-type inclined rolling mill, no tensile stress will occur during reduction while plastic deformation is accomplished only with compressive stresses acting in the direction of reduction, and therefore the Mannesmann effect will be inhibited even under rotary forging. Here, to supplement the discussion briefly, there are some patent applications for techniques of using roller shoes instead of disc rolls (Patent Literature 5 (Japanese Patent Application Publication No. H10-94808) and Patent Literature 6 (Japanese Patent Application Publication No. 2001-259710)), but their proposals relate to roller guide shoes, not rolling rolls.

The present invention has been made in view of these technical circumstances, and therefore an object of the present invention is to provide a method for producing a seamless metal pipe which is capable of producing a thin-wall mother pipe (hollow piece) at a high reduction rate particularly from a billet made of a less formable material by virtue of employing a 4 roll-type inclined rolling mill.

Solution to Problem

The method of the present invention is configured to piercing-roll a solid billet, the method including: using a 4 roll-type inclined rolling mill that includes a pair of larger-diameter cone-type main rolls supported at both ends and arranged horizontally or vertically to face each other across a pass line, and a pair of smaller-diameter auxiliary rolls supported at both ends and arranged vertically or horizontally to face each other similarly across the pass line between the facing main rolls; and maintaining a feed angle β of the cone-type main rolls, a cross angle γ of the main rolls, a feed angle β' of the auxiliary rolls of a cone type, and a cross angle γ' of the auxiliary rolls to be within following ranges.

$$5° \leq \text{“}\beta, \beta'\text{”} \leq 25°$$

$$3° \leq \text{“}\gamma, \gamma'\text{”} \leq 35°$$

$$10° \leq \text{“}\beta+\gamma, \beta'+\gamma'\text{”} \leq 55°$$

More preferably, the solid billet is expanding-piercing-rolled so that a diameter $d_0$ of the solid billet, a diameter d of a hollow piece alter the piercing, and a wall thickness t of the hollow piece together satisfy a following relationship.

$$1.5 \leq -\Psi_r/\Psi_\theta \leq 4.5$$

where $\Psi_r = \ln(2\ t/d_0)$ $\Psi_\theta = \ln\ \{2(d-t)/d_0\}$

Advantageous Effects of Invention

With the method of the present invention, it is possible to produce an ultrathin-wall hollow piece at a high reduction rate from a billet made of a less formable material such as a stainless steel or a high alloy steel without causing flaring or peeling. In addition, it is possible to inhibit inner surface flaws or laminations, which are likely to occur during the process of high reduction rate thin-wall piercing-rolling, by optimizing the relationship between the diameter of the cone-type main rolls and the diameter of the solid billet and optimizing the relative relationship between the pipe expansion ratio of the pipe material and the diameter expansion ratios of the main rolls and the auxiliary rolls.

DESCRIPTION OF EMBODIMENTS

Figure 1:
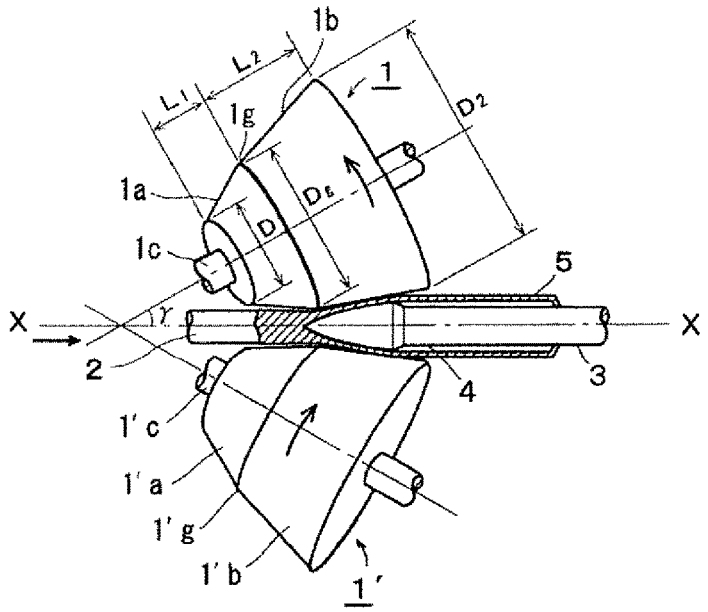
FIG.1 PRIOR ART
FIG. 1 is an illustration of the 2 roll-type piercing-rolling technique in connection with the prior inventions, with the plan view schematically showing a state of piercing-rolling.

Preferred embodiments of the present invention will now be described in detail with reference to the accompanying drawings. Throughout the specification and drawings, constituent elements having substantially the same function and arrangement are denoted by the same reference numerals, and redundant description is therefore omitted.

Hereinafter, the method of the present invention will be described in comparison with the prior inventions.

Figure 2:
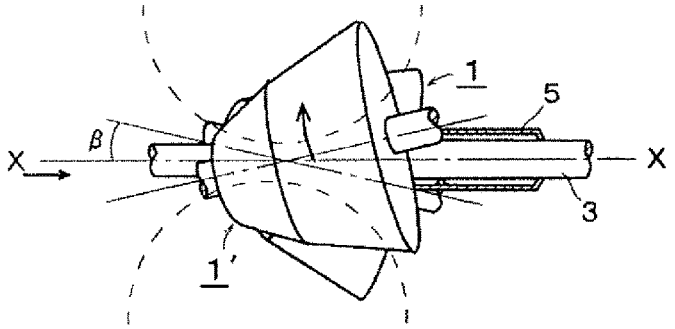
FIG.2 PRIOR ART
FIG. 2 is a side view schematically showing the state of piercing-rolling.
Figure 3:
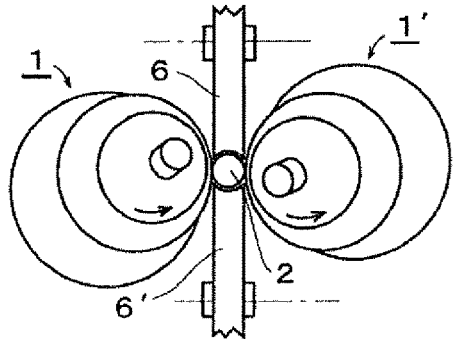
FIG.3 PRIOR ART
FIG. 3 is a front view schematically showing the state of piercing-rolling, as seen from the entry side.

FIGS. 1 to 3 are illustrations of the 2 roll-type piercing-rolling technique in connection with the prior inventions, among which FIG. 1 is a plan view schematically showing a state of piercing-rolling, FIG. 2 is a side view thereof, and FIG. 3 is a front view thereof as seen from the entry side. As shown in FIGS. 1 and 2, the main rolls 1, 1' have a cone type of shape with the tips thereof directed toward the solid billet 2 entry side, and the positions at which the roll surfaces 1*a*, 1'*a* at the entry side and the roll surfaces 1*b*, 1'*b* at the exit side intersect each other, respectively, are the gorge portions 1*g*, 1'*g*. Both ends of each roll shaft 1*c*, 1'*c* are held by support frames (not shown).

The roll shafts 1*c*, 1'*c* are mounted in an inclined manner so that their extensions have feed angles β with respect to a plane (horizontal plane in the illustrated example) containing the pass line with the feed angles being equal to each other but having opposite orientations (see FIG. 2) and also cross angles γ with respect to a vertical plane containing the pass line with the cross angles being equal to each other but having opposite orientations (see FIG. 1), and they rotate in the same direction at the same angular velocity as shown by the arrows.

As shown in FIG. 3, disc rolls 6, 6' are provided between the main rolls 1, 1' with a solid billet 2 disposed therebetween.

The solid billet 2 is pierced by a plug 4 supported on a mandrel 3 to be formed into a hollow piece 5.

In contrast, the method of the present invention employs, in place of disc rolls, cone-type auxiliary rolls having functions and advantages comparable to those of the cone-type main rolls.

Figure 6:
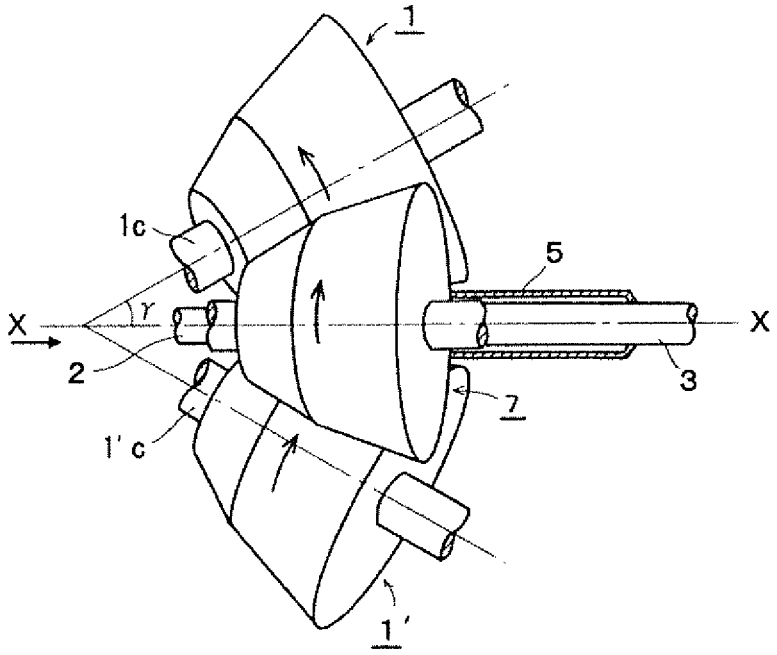
FIG. 6 is an illustration of the 4 roll-type piercing-rolling technique in connection with the present invention, with the plan view schematically showing a state of piercing-rolling.
Figure 7:
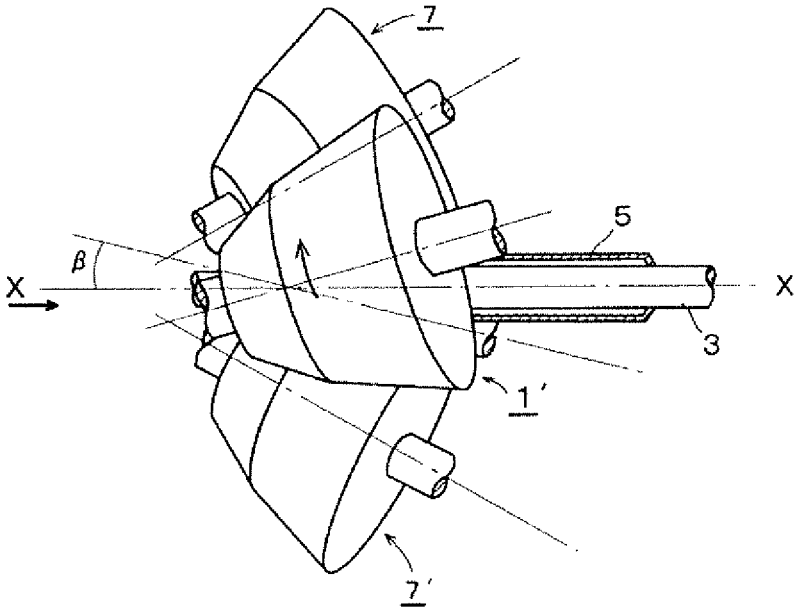
FIG. 7 is a side view schematically showing the state of piercing-rolling.
Figure 8:
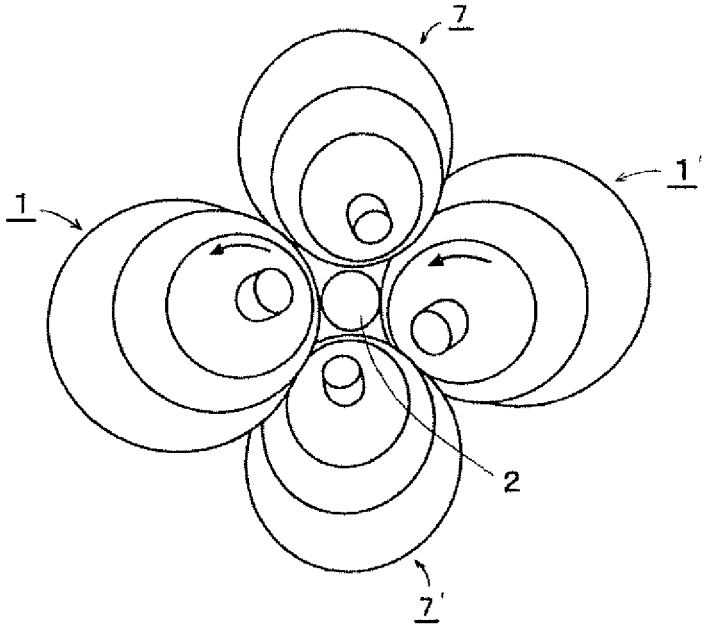
FIG. 8 is a front view schematically showing the state of piercing-rolling, as seen from the entry side.

FIGS. 6 to 8 are illustrations of the 4 roll-type piercing-rolling technique in connection with the present invention, among which FIG. 6 is a plan view schematically showing a state of piercing-rolling, FIG. 7 is a side view thereof, and FIG. 8 is a front view thereof as seen from the entry side. As shown in FIGS. 6 and 7, the cone-type main rolls 1, 1' are arranged horizontally to face each other across the pass line (X-X line), and cone-type auxiliary rolls 7, 7' are vertically arranged to face each other similarly across the pass line between the main rolls 1, 1' that face each other.

The roll shafts 1*c*, 1'*c* of the main rolls are mounted in an inclined manner so that their extensions have feed angles β with respect to a plane (horizontal plane in the illustrated example) containing the pass line with the feed angles being equal to each other but having opposite orientations (see FIG. 7) and also cross angles γ with respect to a vertical plane containing the pass line with the cross angles being equal to each other but having opposite orientations (see FIG. 6). The main rolls 1, 1' rotate in the same direction at the same angular velocity as shown by the arrows. The roll shafts 7*c*, 7'*c* of the auxiliary rolls 7, 7' are similarly mounted in an inclined manner with feed angles β' and cross angles γ', and they rotate in the same direction at the same angular velocity. By employing the 4 roll-type piercing-rolling technique, it is possible to achieve functions and advantages described below.

Figure 4:
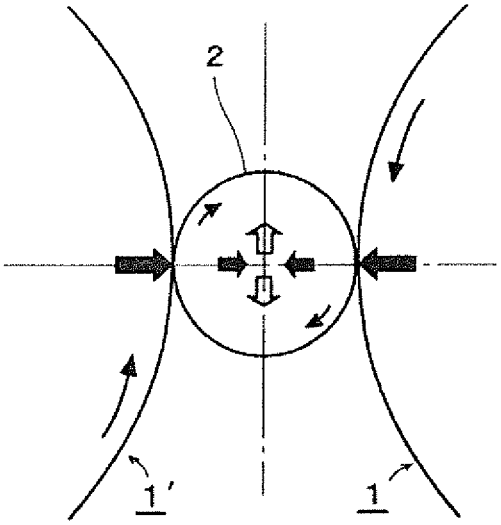
FIG.4 PRIOR ART
FIG. 4 is an illustration of a state of stresses acting on the central portion of a billet during 2 roll-type piercing-rolling in connection with the prior inventions.

FIG. 4 is an illustration of a state of stresses acting on the central portion of a billet during 2 roll-type piercing-rolling in connection with the prior inventions. When a solid billet is subjected to rotary-forging in a 2 roll-type inclined rolling mill, compressive stresses act on the central axis portion of the solid billet in the direction of reduction and tensile stresses occur in the direction perpendicular to the direction of reduction, with the result that the so-called Mannesmann phenomenon occurs at the centerline segregation, inclusions, or centerline porosity serving as the initiation point, and if the phenomenon is excessive, it will cause a failure.

Figure 5:
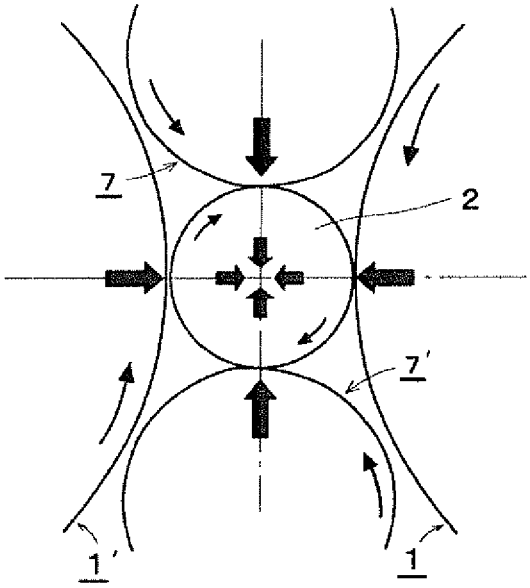
FIG. 5 is an illustration of a state of stresses acting on the central portion of a billet during 4 roll-type piercing-rolling in connection with the present invention.

FIG. 5 is an illustration of a state of stresses acting on the central portion of a billet during 4 roll-type piercing-rolling in connection with the present invention. When a 4 roll-type inclined rolling mill is employed instead of the 2 roll-type inclined rolling mill, no tensile stress will occur during reduction while plastic deformation is accomplished only with compressive stresses acting in the direction of reduction, and therefore the occurrence of the Mannesmann effect can be inhibited even under rotary forging.

When cone-type auxiliary rolls having functions and advantages comparable to those of the cone-type main rolls are employed in place of disc rolls, for the main rolls and the auxiliary rolls, the relationships between the pipe expansion ratio $d/d_0$ of the pipe material and the respective diameter expansion ratios $D_2/D_1$ and $D_2'/D_1'$, of the main rolls and auxiliary rolls, correspond to those of the prior inventions, where the roll inlet diameters are denoted as D1, D1' and the roll outlet diameters are denoted as D2, D2', and thus the following relationships still hold.

$$(d/d_0)/(D_2/D_1)<0.75+0.025\gamma$$

$$(d/d_0)/(D_2'/D_1')<0.75+0.025\gamma'$$

In the present invention, the roll diameter of the auxiliary rolls is smaller than the roll diameter of the main rolls, and this is intended to enlarge the dimensional range that can be obtained by piercing as much as possible by giving a large roll gap adjustment margin to the main rolls. In this connection, if the outlet diameters of the main rolls and the auxiliary rolls are equal, it is impossible to obtain a hollow piece in which the diameter d is not more than $(2^{1/2}-1)D_2$ due to the geometric limitations.

Furthermore, with the 4 roll-type, the rolling mill has a more complicated overall configuration, in which the smaller-diameter auxiliary rolls can be =driven while the piercing-rolling loads of the auxiliary rolls are borne by the driving power for the main rolls.

The gorge positions of the main rolls and auxiliary rolls need to be aligned with each other although their roll diameters may be varied, and preferably, the entry-side barrel lengths ($L_1$, $L_1'$) forward of the gorge positions are equal to each other and the exit-side barrel lengths ($L_2$, $L_2'$) rearward of the gorge positions are equal to each other ($L_1=L_1'$, $L_2=L_2'$).

The present invention is not limited to a solid billet, to which the description above is directed, but it is also applicable to production methods using a hollow billet formed by bore machining.

EXAMPLES

Detailed descriptions of examples are given below.

Example 1

Hot workability of high alloy steels is poorer than that of stainless steels, and if their temperatures for piercing-rolling are more than 1275° C., laminations often occur. In this example, using specimens of a billet made of a 25% Cr-35% Ni-3Mo high alloy steel and having a diameter of 70 mm, with their temperature for piercing-rolling being 1200° C., high reduction rate thin-wall piercing-rolling at a pipe expansion ratio of 2 was performed as the main rolls and auxiliary rolls were being driven. Conditions for the main rolls and auxiliary rolls and conditions for piercing-rolling were as follows.

1. Conditions for Main Rolls
   Cross angle . . . γ=30°
   Feed angle . . . β=12°
   Gorge diameter . . . $D_g$=500 mm
   Inlet diameter . . . $D_1$=300 mm
   Outlet diameter . . . $D_2$=670 mm
   Roll diameter expansion ratio . . . $D_2/D_1$=2.23
   Entry-side barrel width . . . $L_1$=300 mm
   Exit-side barrel width . . . $L_2$=460 mm
   Barrel width . . . $L_1+L_2$=760 mm
   Barrel width ratio . . . $L_2/L_1$=1.53
   Roll rotational speed n=60 rpm
2. Conditions for Auxiliary Rolls
   Cross angle . . . γ'=30°
   Feed angle . . . β'=12°
   Gorge diameter . . . $D_g'$=400 mm
   Inlet diameter . . . $D_1'$=240 mm
   Outlet diameter . . . $D_2'$=536 mm
   Roll diameter expansion ratio . . . $D_2'/D_1'$=2.23
   Entry-side barrel width . . . $L_1'$=300 mm
   Exit-side barrel width . . . $L_2'$=460 mm
   Barrel width . . . $L_1'+L_2'$=760 mm
   Barrel width ratio . . . $L_2'/L_1'$=1.53
   Roll rotational speed . . . n'=75 rpm
3. Piercing-Rolling Conditions Plug diameter … $d_p$ = 130 mm Billet diameter … $d_0$ = 70 mm Hollow piece diameter … $d$ = 140 mm Hollow piece wall thickness … $t$ = 3.5 mm Pipe expansion ratio … $d/d_0$ = 2.00

Piercing-rolling ratio … $d_0^2/4t(d-t)$ = 2.56

-continued

"Wall thickness/Outside diameter" ratio … $(t/d)\times 100 = 2.5\%$

Roll shape factor … $(d/d_0)/(D_2/D_1) = (d_2/d_0)/(D_2'/D_1') = 0.897$

Thicknesswise logarithmic strain … $\psi_r = \ln(2t/d_0) = \ln 0.10 = -2.303$

Circumferential logarithmic strain … $\psi_\theta =$ $$\ln\{2(d-t)/d_0\} = \ln 3.90 = 1.361$$

Reduction distribution ratio … $-\psi_r/\psi_\theta = 1.692$

As described above, the reduction distribution ratio between the circumferential reduction and the thicknesswise reduction was appropriate and the roll shapes were optimized, and as a result, the piercing-rolling was accomplished without any problems although it was high reduction rate thin-wall piercing-rolling of a high alloy steel, which has poor hot workability.

Example 2

Using specimens of a billet made of an 18% Cr-8% Ni austenitic stainless steel and having a diameter of 60 mm, high reduction rate thin-wall piercing-rolling at a pipe expansion ratio of 1.5 was performed as the main rolls only were being driven while the auxiliary rolls were left undriven. The billet was heated to 1250° C. Hot workability of stainless steels is much poorer than that of carbon steels. Conditions for the main rolls and auxiliary rolls and conditions for piercing-rolling were as follows.

1. Conditions for Main Rolls
   Cross angle $\gamma$=25°
   Gorge diameter . . . $D_g$=400 mm
   Feed angle . . . $\beta$=12°
   Inlet diameter . . . $D_1$=240 mm
   Outlet diameter . . . $D_2$=550 mm
   Roll diameter expansion ratio . . . $D_2/D_1$=2.29
   Entry-side barrel width . . . $L_1$=300 mm
   Exit-side barrel width . . . $L_2$=460 mm
   Barrel width . . . $L_1+L_2$=760 mm
   Barrel width ratio . . . $L_2/L_1$=1.53
   Roll rotational speed . . . n=60 rpm
2. Conditions for Auxiliary Rolls
   Cross angle . . . $\gamma'$=25°
   Gorge diameter . . . $D_g'$=320 mm
   Feed angle . . . $\beta'$=12°
   Inlet diameter . . . $D_1'$=192 mm
   Outlet diameter . . . $D_2'$=440 mm
   Roll diameter expansion ratio . . . $D_2'/D_1'$=2.29
   Entry-side barrel width . . . $L_1'$=300 mm
   Exit-side barrel width . . . $L_2'$=460 mm
   Barrel width . . . $L_1'+L_2'$=760 mm
   Barrel width ratio . . . $L_2'/L_1'$=1.53
   Roll rotational speed . . . n'=(undriven)
3. Piercing-Rolling Conditions Plug diameter … $d_p = 80$ mm Billet diameter … $d_0 = 60$ mm Hollow piece diameter … $d = 90$ mm Hollow piece wall thickness … $t = 2.7$ mm Pipe expansion ratio … $d/d_0 = 1.50$ -continued Piercing-rolling ratio … $d_0^2/4t(d-t) = 3.82$ "Wall thickness/Outside diameter" ratio … $(t/d)\times 100 = 3.0\%$ Roll shape factor … $(d/d_0)/(D_2/D_1) = (d/d_0)/(D_2'/D_1') = 0.655$ Thicknesswise logarithmic strain … $\psi_r = \ln(2t/d_0) = \ln 0.09 = -2.408$ Circumferential logarithmic strain … $\psi_\theta =$ $$\ln\{2(d-t)/d_0\} = \ln 2.91 = 1.068$$

Reduction distribution ratio … $-\psi_r/\psi_\theta = 2.255$

As described above, the reduction distribution ratio between the circumferential reduction and the thicknesswise reduction, i.e., the reduction distribution ratio between the longitudinal reduction and the circumferential reduction was appropriate, and as a result, the piercing-rolling was accomplished without causing flaring or peeling. Since the roll shapes were also optimized, the occurrence of inner surface flaws or laminations were not observed although it was high reduction rate ultrathin-wall piercing-rolling of a less formable material.

In the foregoing description, preferred embodiments of the present invention have been set forth in detail with reference to the accompanying drawings, but the present invention is not limited to such examples. It will be apparent that those having general knowledge in the field to which the present invention belongs may find various alternations and modifications within the scope of the technical ideas described in the appended claims, and it should be understood that they will naturally come under the technical scope of the present invention.

INDUSTRIAL APPLICABILITY

The method of the present invention is a method using a 4 roll-type inclined rolling mill employing cone-type auxiliary rolls having functions and advantages comparable to those of the cone-type main rolls in place of disc rolls, and the method is capable of being effectively utilized particularly in piercing-rolling a less formable material such as a stainless steel or a high alloy steel.

REFERENCE SIGNS LIST

1, 1': main roll
2: solid billet
3: mandrel
4: plug
5: hollow piece
6, 6': disc roll
7, 7': auxiliary roll

The invention claimed is:

1. A method for producing a seamless metal pipe, the method comprising:

piercing-rolling a solid billet using a 4 roll inclined rolling mill that includes a pair of cone-shaped main rolls having roll shafts supported at opposing ends thereof and arranged horizontally or vertically to face each other across a pass line and a pair of cone-shaped auxiliary rolls having roll shafts supported at opposing ends thereof and arranged vertically or horizontally to face each other similarly across the pass line between the facing main rolls, wherein the diameter of the main rolls is larger than the diameter of the auxiliary rolls; and maintaining a feed angle β of the cone-shaped main rolls, a cross angle γ of the main rolls, a feed angle β' of the auxiliary rolls, and a cross angle γ' of the auxiliary rolls to be within following ranges:

$5° \leq \beta, \beta' \leq 25°$;

$3° \leq \gamma, \gamma' \leq 35°$;

and $10° \leq \beta+\gamma, \beta'+\gamma' \leq 55°$.

2. The method for producing a seamless metal pipe according to claim 1, wherein the step of piercing-rolling the solid billet is expanding-piercing-rolling the solid billet so that a diameter $d_0$ of the solid billet, a diameter d of a hollow piece after the expanding-piercing-rolling, and a wall thickness t of the hollow piece together satisfy a following relationship:

$1.5 \leq -\Psi_r/\Psi_\theta \leq 4.5$ where $\Psi_r = \ln(2t/d_0)\Psi_\theta = \ln\{2(d-t)/d_0\}$.

3. The method for producing a seamless metal pipe according to claim 2, wherein the piercing-rolling is performed so that an inlet diameter $D_1$, an outlet diameter $D_2$, and a roll cross angle γ of the cone-shaped main rolls and also an inlet diameter $D_1'$, an outlet diameter $D_2'$, and a roll cross angle γ' of the cone-shaped auxiliary rolls satisfy relationships with the diameter $d_0$ of the solid billet and the diameter d of the hollow piece after the piercing as follows:

$(d/d_0)/(D_2/D_1) < 0.75+0.025\gamma$;

and $(d/d_0)/(D_2'/D_1') < 0.75+0.025\gamma'$.

4. The method for producing a seamless metal pipe according to claim 2, wherein the solid billet is piercing-rolled as the main rolls are being driven while the auxiliary rolls are left undriven.

5. The method for producing a seamless metal pipe according to claim 1, wherein the solid billet is piercing-rolled as the main rolls are being driven while the auxiliary rolls are left undriven.

* * * * *